United States Patent [19]

Muller

[11] Patent Number: 4,913,804

[45] Date of Patent: Apr. 3, 1990

[54] DEVICE AND PROCESS FOR SEPARATING GRANULAR MATERIAL

[76] Inventor: Roman Muller, Buelhofstrasse 22, CH-9244 Niederuzwil, Switzerland

[21] Appl. No.: 303,025

[22] Filed: Jan. 25, 1989

Related U.S. Application Data

[63] Continuation of Ser. No. 834,326, Mar. 6, 1986, abandoned, which is a continuation-in-part of Ser. No. 817,730, filed as PCT EP85/00209 on May 8, 1985, published as WO85/05050 on Nov. 21, 1985, Pat. No. 4,652,362.

[30] Foreign Application Priority Data

May 8, 1984 [CH] Switzerland ..... 2240784-8

[51] Int. Cl.[4] ..... B03B 4/00; B07B 9/02

[52] U.S. Cl. ..... 209/44.2; 209/312; 209/318; 209/466; 209/494; 209/694; 209/695

[58] Field of Search ..... 209/44.1, 44.2, 2, 19, 209/466, 467, 468, 469, 486, 494, 312, 314, 316, 318, 322, 680, 682, 691, 694, 695

[56] References Cited

U.S. PATENT DOCUMENTS

| | | | |
|---|---|---|---|
| 1,068,163 | 7/1913 | Payne . | |
| 1,786,739 | 12/1930 | Davis | 209/467 |
| 2,928,545 | 3/1960 | Forsberg | 209/467 |
| 3,464,550 | 9/1969 | Bieler et al. | 209/694 |
| 3,693,794 | 9/1972 | Oetiker | 209/467 X |
| 4,319,990 | 3/1982 | Muller | 209/240 |
| 4,466,542 | 8/1984 | Oetiker et al. | 209/44.2 |
| 4,652,362 | 3/1987 | Mueller | 209/466 X |

FOREIGN PATENT DOCUMENTS

| | | | |
|---|---|---|---|
| 715598 | 1/1942 | Fed. Rep. of Germany | 209/468 |
| 817390 | 10/1951 | Fed. Rep. of Germany . | |
| 2104537 | 8/1972 | Fed. Rep. of Germany . | |
| 2446673 | 8/1980 | France . | |
| 547667 | 4/1974 | Switzerland . | |
| 1042817 | 9/1983 | U.S.S.R. . | |
| 1545821 | 5/1979 | United Kingdom . | |

*Primary Examiner*—Andres Kashnikow

*Attorney, Agent, or Firm*—Merchant, Gould, Smith, Edell, Welter & Schmidt

[57] ABSTRACT

The device consists of two fluidized bed tables (2, 3) which can vibrate on their support, an can be inclined as desired, allowing a common airflow to pass through. Located over the top end of the upper fluidized bed (2) is an inlet (1) for the granular material, opposite which, at the bottom end, is an outlet (14) for the very light granular fraction. At the top end of the lower fluidized bed (3) are a stone outlet (13) and, at the lower end, an outlet (15) for the heavy granular fraction. In addition, a chute (19) is situated between the fluidized beds (2, 3). An intermediate floor (17), shorter in length than the fluidized bed (2, 3) allows the evacuation and if necessary the regulation of a mixed fraction. In order to be able to remove a mixed fraction, with the easiest possible design, it is envisaged that the fluidized beds (2, 3) are arranged in a sturdy but movable frame (4), operated by a vibratory drive (5) with a vibratory movement directed towards the stone outlet (13) and that the intermediate floor (17) is tilted towards the bottom end of the lower fluidized bed (3).

20 Claims, 7 Drawing Sheets

DEVICE AND PROCESS FOR SEPARATING GRANULAR MATERIAL

CROSS REFERENCE TO RELATED APPLICATION

Figure 1:
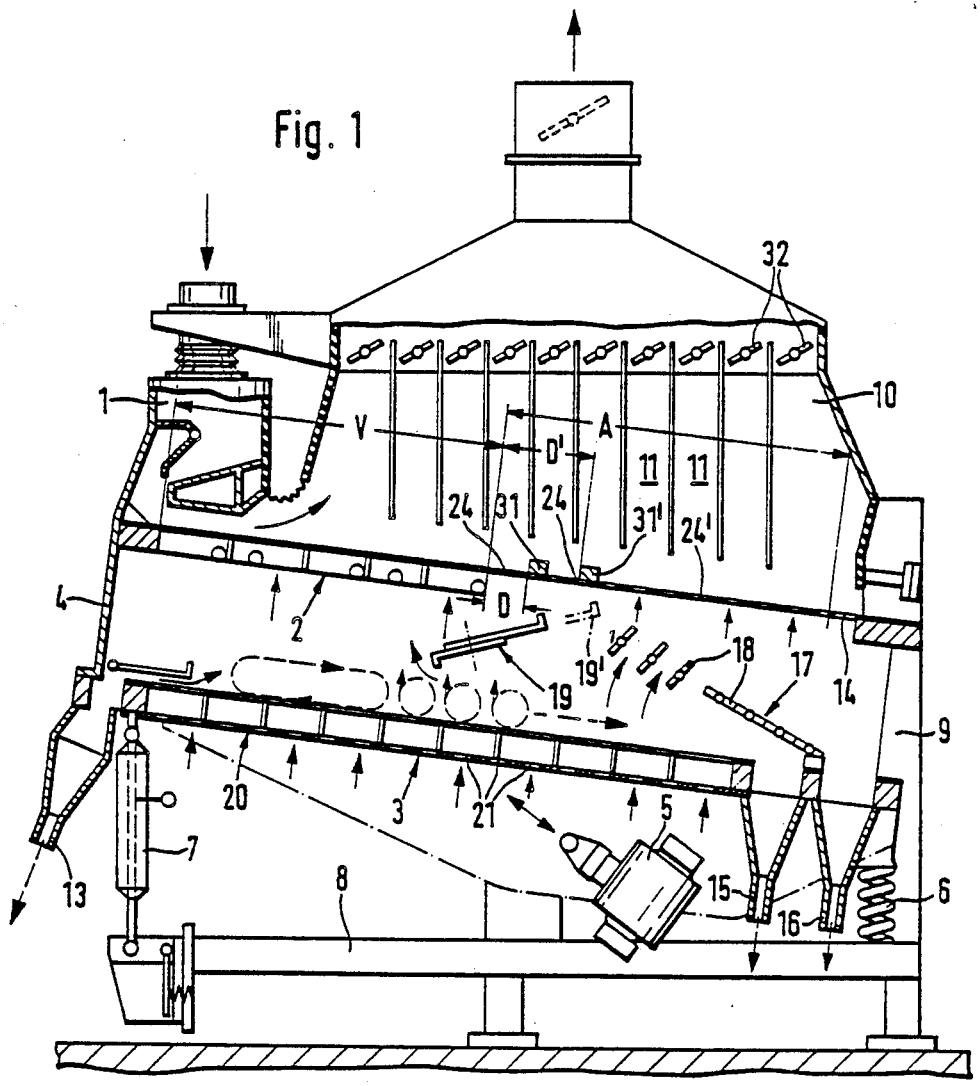

This is a continuation of application Ser. No. 834,326 filed Mar. 3, 1986, abandoned, which is a continuation-in-part of application Ser. No. 817,730 filed as PCT EP85/00209 on May 8, 1985, published as WO85/05050 on Nov. 21, 1985, now U.S. Pat. No. 4,652,362.

The invention concerns a contrivance for separating granular product into several fractions, with two fluidized bed tables journaled in vibratory fashion and adjustable in their inclination and capable of being permeated by a common stream of air, there being disposed above the higher end of the upper flow bed table an inlet for the granular product, opposite to which at the lower end is an outlet for the lightest grain fraction and there further being present at the higher end of the lower fluidized bed table a stone outlet and, at the lower end, an outlet for the heavy granular fraction, and with an intermediate floor of lesser length disposed between the fluidized bed tables as the fluidized bed tables for leading off a mixed fraction, which extends from the lower end of the fluidized bed tables in the direction opposite to the higher end.

UNDERLYING STATE OF THE ART

For cleaning cereals (grains), all foreign components as well as dirt must be removed prior to grinding. Cleaning follows in several stages. Large foreign bodies are usually separated out with sifting mechanisms with the mesh size being selected in each case such that the totality of granular product will be recovered with certainty as siftings, and that all parts (pieces) that are larger than the expellate will be separated out. Fine dirt and fine sand can be simultaneously separated out by a correspondingly finely perforated sieve. In this manner, one obtains the actual granular product along with an unfriendly occupation force that consists, in particular, of small stones, splinters of glass along with metal parts as well as various light trimmings (such as large pieces of husk, broken pieces of stalk and unfriendly seedlings) that all lie within a given spectrum of grain sizes, e.g. in the case of varieties of wheat in the region from 2 mm to 6 mm or, in the case of maize, in the area between 5 mm and 20 mm. Depending upon their outer shape and size, the light components are separated out by special sorting tables (such as for example Paddy sorters or light grain sorters). Up until about 20 years ago, a large portion of the granular product initially passed through a sieve in this manner over a predetermined range of granulation and, freed from the light components, was fed through a water bed and, in so doing, the adhering dirt along with the stones were floated out. Because of their greater weight, the stones could be collected on the floor of the washing machine using the deposit method.

The great advantage of this cleaning method applied since long ago, in broad scope, lies in its very great cleaning action, the disadvantage, however, in the occurrence of very large amounts of soiled wash water which, because of the danger of microbiological contamination (infestation), might be used only once and then had to be cleaned again.

Proposed in the German Auslegeschrift* 3 148 475 is a new way for separating cereals and similar granular product into individual fractions. Here, the three main fractions, namely the heavy grain, the light grain and the stones are sorted from the cereals with a single machine. Standing in the foreground here:

1. a cleaner separation into heavy and light grain, as well as
2. a good and complete sorting of stones with a single pass through a machine, however, using two vibrating tables disposed over one another and permeated (flowed through) by the same air.

*Auslegeschrift = Patent application published for opposition, printed specification of the application after examination.

However, in order to meet these high quality requirements, it is necessary to carry out each work step under optimal conditions. The upper vibrating table serves primarily for the purpose of a cleaner separation of the light fraction and for this purpose displays an elongated form, being capable of being adjusted at a slight inclination from the inlet end to the outlet end and being brought in the direction toward the outlet with a casting movement, so that the product can be conveyed continuously over the slight inclination.

However, in the case of the known contrivance, it has been shown that it is indispensable, for proper functioning, that the amount of air along the vibrating tables be able to be set in step fashion. Used for this purpose is an aspiration hood with a shutter-like division, there being associated to each intermediate space an individually adjustable (settable) air damper. With this, it is possible to generate on the top vibration table a fluidized bed that is specially adaptable to the product and the throughput amount. Occurring over a first section of the top vibrating table by means of oscillatory motion and the flowing of air, is a concentration of the heavy product in a layer immediately over the vibrating table, and formed directly over this latter is a second upper layer of light product that has been freed of the heavy product.

Next, along a second section, the heavy product is dropped down onto the lower vibrating table located immediately thereunder, the task for which consists of sorting the heavy product and those parts (pieces) displaying a greater specific weight (such as stones, glass, metal, etc.). The lower vibrating table is also outfitted for this purpose with a vibrating drive which, however, generates a casting/oscillatory motion opposing that of the upper vibrating table. The lower vibrating table is inclined in the same direction as the upper vibrating table, however its oscillatory motion is aimed in the direction toward the higher-located outlet for the heaviest parts.

The cost of construction of the known device (and therewith also its price) is, however, so great that narrow limits are already set by this for application of this device.

Moreover, it has been shown still further that in the case of this type of construction only a limited increase in product throughput is possible, since, in the case of too great throughput capacities, precise guiding of the fluidized layer is no longer accomplished sufficiently well enough by controlling the local amount of air and, therewith, building up the desired layering can no longer be achieved in the desired measure.

Now, the task underlying the invention is to eliminate the demonstrated disadvantages of the known contrivance and to achieve better utilization of the given vibrating table surfaces, without impairing the sorting of stones, in particular in order to be able to simultaneously sort out a mixed fraction with greater sharpness of separation.

The solution in accordance with the invention is characterized by the fact that the fluidized bed tables are disposed in a stiff frame journaled in vibratory fashion, to which is associated a common vibratory drive whose casting/oscillatory motion is aimed toward the stone outlet, and that the intermediate floor is inclined toward the lower end of the bottom fluidized bed table.

Preferentially, the two vibrating tables are disposed in parallel.

Both of these measures permit not only an essential simplification as compared to the German Auslegeschrift 3 148 475, but rather a noticeable rise in performance capability of the entire contrivance. The intermediate floor permits in simple fashion drawing off a mixed fraction, so that, in accordance with the invention, all functions can be carried out optimally and rationally. The new invention allows an entire series of other ideas for embodiment.

It is particularly advantageous if, in the case of the upper fluidized bed table, a zone of coarse perforations is produced adjacent to a first region, transversely over the fluidized bed table.

Further preferred to be provided adjacent to the zone of coarse perforations is a threshold, transversely over the fluidized bed table, with the threshold being at a height that is once to twice the average grain dimension, maximum, however, about half the layer thickness to be expected.

Preferentially, the upper fluidized bed table is divied, in the direction from the inlet toward the outlet for the lightest grain fraction, into two successive areas of different perforation, such that the stones and heavy grain fraction can fall through the fluidized bed table only in the region of coarse perforations.

In order that a cleaner separation of the light fraction can also be achieved, provided in the second region of the upper fluidized bed table are opposingly adjustable sidewalls for the working surface of the upper fluidized bed table which, with their ends facing toward the outlet for the lightest grain fraction, are pivotable relative to one another for the purpose of being able to taper, wedge-fashion, the effective surface of the upper fluidized bed table toward the outlet for the lightest grain fraction.

Further provided, in very advantageous fashion, under the second area of the upper fluidized bed table is a slide, dropping off toward the outlet for the stones and passing by below the slot and/or the zone of coarse perforations, with the slide capable of being adjusted between the first area (region) and the adjacent zone of coarse perforations and/or a slotted opening.

Preferentially, the slide terminates approximately at mid-height between the two fluidized bed tables and, over the length of the lower fluidized bed table, approximately within the middle onethird.

In another particularly preferred idea for embodiment, disposed in the region following the first region is an intermediate floor that is inclined toward the lower end of the bottom fluidized bed table. Here, the intermediate floor is disposed such that it intersects the fluidized bed tables at an angle of 25° to 45° and that the inclination of the fluidized bed tables, with reference to the horizontal, is 5° to 10°.

Preferentially, the intermediate floor is formed by a plurality of flat profiles that are journaled inside the housing in rotatable fashion about their longitudinal central axis, so that by swinging away or moving together, an appropriate mixed fraction can be set.

In this fashion, it is possible to select very sharply three fractions:

a heavy grain fraction
a mixed fraction and
a light fraction.

Here, the flat profiles can be adjusted such that in coplanar alignment they touch one another. However, they can also be stepped such that there is an air throughpass opening between the steps.

In a further development of these ideas, the lower fluidized bed table can be constructed, under the intermediate floor, as a gutter-like depression with an air-impermeable floor, said depression guiding the heavy grain fraction into the appropriate outlet. Quite particularly optimal and also stable operating conditions occur if the exhaust air cross-section opening is subdivided into zones that are adjustable in cross-section, at some distance apart, over the top fluidized bed table. In doing this, each one should display an adjustable flapper for setting the amount of air.

For an optional functioning of the bed table, this latter is equipped with a large number of fine perforations, however with a smooth surface. With this measure, because of the upwardly conveying casting/oscillating movement, achieved is a strong restraining action for the product lying immediately on the upper vibrating table. Arising therewith on the top table is an almost shearing effect causing all heavy parts, having once entered into the lower layer that is prevented from a fast outflow, can again spring back into the upper layer either by means of the air or by the vibratory motion. The layering effect on the upper table is strongly intensified by this last measure. This allows utilizing optimally the required air quantity as well as vibratory energy, so that, now, capable of being accomplished over a very short length of table, on the same table surface, is the processing of an essentially greater throughput capacity and/or a cleaner layering.

In a further development of this idea, the stone sorting table, as a product deposit surface, is constructed as an air-permeable mesh screen in parallel with a good, non-permeable mesh screen, and at some distance below a finely perforated plate, and in between a shutter-like structure (sandwich), such that the lower vibrating table with the finely perforated plate yields an approximately constant air resistance over the entire product deposit surface, independently of the thickness of the layer of product on the lower fluidized bed table. Preferentially, the stone sorting table displays a rough surface, so that the heavy parts are conveyed, because of the upswing motion, toward the higher located outlet for the heavy parts. The restraining effect, utilized for the top vibrating table against the casting movement directed toward the direction of flow of the product, is utilized here for the actual uphill conveying of the lower layer that is enriched with the heaviest of the components.

If one judges the method of operation of the new contrivance, there then occurs a new nucleus of an idea. The strong point here now lies in the fact that provided for the product is the greatest possible area of distribution over both the top table in one region and also over the entire lower table, however such that the entire working surface is uniformly acted upon with product, and starting in, transversely to the direction of flow, at each point, is a practically identical work cycle. The work cycle is executed progressively and sequentially over the appropriate table surfaces from the start of entering into production up to the point at which the appropriate work step is terminated. For the top vibrating table, this means that the product is deposited over the entire width of the table in a uniform layering right at the beginning of the table and, subsequent layering is accomplished, undisturbed, up until the point of transfer of the lower layer onto the stone sorting table located thereunder. It is only after complete layering has been accomplished that the entire under-layer enriched with the heavy parts is drawn off as fallthrough in the quite short section. Accordingly, on the lower sifting table, the product is once again deposited, veil fashion, in a defined zone, as uniformly as possible over the entire width of the stone sorting table. From this zone, forming in turn in both the direction to the higher located end of the table and the lower located end of the table, over the entire surface, is a surprisingly uniform layering and/or fluidized bed. The short section of fallthrough for sorting of stones is preferentially at most one-fifth of the first product-permeable region.

To be sure, contributing essentially to this good result is also the utilization of the finely perforated plate along with the sandwich-like construction of the stone sorter, since by this means, at least over the lower table area, occurring over the entire surface is a uniform air velocity, so that also supported therewith is the formation of a uniform fluidized layer.

In another preferred form of embodiment, the top table area is constructed, in the region where product is fed in, in air-permeable fashion, and a short piece at some distance over the table area is covered over for the purpose of forming a stream of air in the direction of the incoming stream of product. In this manner, the product to be freshly deposited on the table simultaneously receives, at the location of entrance, an impact so that the casting movement that wants to throw the product upwardly in the reverse direction, in the region of the inlet,results in a significant conveying toward the lower located end of the table.

The invention further concerns a method for sorting out individual fractions from the bulk product, in particular from cereals, by means of two table areas inclined toward the product outlets, flowed through by the same air and set into oscillation (vibration) in common, with a casting movement in the direction toward the higher located end of the table being impressed on both.

The solution in accordance with the invention is characterized by the fact that (a) the product on the top table surface along a first region (V), without precipitation, is initially layered into a layer of heavy product containing all of the heaviest components, and (then) into a top layer freed of the heaviest components, that (b) the layer of heavy product and/or a proportion from 20 to 60% with all of the heaviest components is drawn off and cast off veil-fashion as a supply of the product onto a center region of the lower table surface constructed as a stone sorter, that (c) the remainder of 40 to 80% of the product is further layered on the top table surface, and that, simultaneously, the relatively heavy product advancing therefrom is allowed to fall through the upper table surface, and that (d) at least one portion of the fallthrough is carried off over an intermediate floor disposed between the two table surfaces.

Precisely defined by this is not only the layering process, but also obtained is a singular condition for both the drawing off of the lower sheet that is enriched by the heavy contributions and the recovery of a mixed fraction. An important part of the total product, i.e. 20 to 60% is transferred "bundled" onto the lower table forming the stone sorter. Quite particularly important, moreover, is the fact that, in operation, each vibrating table receives at least 20% or more of the product and, therewith, a true fluidized bed (layer) is formed and/or a type of product carpet is produced, and hence given is the prerequisite for a true layering.

The invention further proposes to undertake feeding of product for the stone sorter in its center region, with theproduct being cast off, locally limited, in veil-fashion. Here, standing in the foreground is that an essential part of the product is drawn off over a short region and transferred, veil-fashion, to the lower table at a center section, advantageously the center one-third.

With the method in accordance with the invention, it has been shown that layering as such can be carried out almost completely over a relatively short path and/or over a short time span. After running through about one-half the top table area, layering into heavy and light fractions is completely terminated. This process (method) can also be carried out continuously with a large bulk stream, and in doing this layering, while increasing product flowthrough, is improved still further. The invention enables two things: first, simultaneously branched off from the overall stream of product is a partial stream and this is given off to the stone sorting table. As differentiated from known methods, this occasions, right from the start, unloading the stone sorting table by part of the product, and/or by the light fraction. This could not be achieved if, for example, during formation of the layers a sifting process is simultaneously carried out wherein, at the same time, both heavy parts and small parts fall downwardly through the sieve. Secondly, further achieved in accordance with the invention is that there are now present at the stone sorting table, at any location, clear runoff conditions, with, in turn, a layering also taking place on the stone sorting table. However, in the case of the stone sorter, layering is carried out by the casting movement and the oppositely and/or table-upwardly directed movement with yet only a small portion of the original stream of product, since on the stone sorting table the greater amount flows directly downward. Taking place on the stone sorting table is a continuous exchange of the various proportions between the lower and the upper layer. By means of both impressed flows the heaviest portion table-upwardly and the lighter fractions table-downwardly, all relatively lighter parts of the upper downwardly floating layer are immediately fed downwardly to the outlet for the granular product.

Preferentially, 20 to 50% of the stream of product is transferred along with the heavy product onto the center region of the lower table surface. In most cases, strived for is that less than 50% of the stream of product will be cast off from the stone sorting table. Being further particularly advantageous is if the veil like product dropping from the top table surface onto the lower table surface is blown through by a strong stream of air. By this means, the falling veil of product is loosened up somewhat so that almost every grain arrives individually on the fluidized bed of the stone sorting table. At the top end of the lower table, a jet of air is preferentially directed over the table surface in order to delimit the fluidized bed. Preferentially, feed of the product to the lower table surface is deflected, relative to the direction of flow, in the opposite direction, onto the upper table via a chute, and then cast off. By means of this measure, the product is additionally loosened and it also enables the air to be aspirated through the two table surfaces and, in the region of the chute, the product is deflected, in the direction opposite to the movement of the product.

The center region of the lower table surface, in the longitudinal direction of same, corresponds approximately to the region of the center one-third of the length of the table.

It is particularly advantageous if a first partial quantity of the remaining product is allowed to pass, via an initial section of the second region (A) directly onto the stone sorting table. The stone sorting process is unloaded by this partial quantity.

However, a first partial quantity of the remaining product can also be added to the heavy product fraction, via an initial section of the second region (A) at the bottom end of the stone sorting table.

Another possibility consists of the fact that a partial quantity of the remaining product is recovered as a mixed fraction as dropthrough of region (A), and the latest fraction is led off of the top table as expellate. This is used particularly when highest claims (demands) are made for recovering all of the individual fractions.

However, it is also possible to supply a partial quantity of the remaining product as dropthrough to the stone sorting table and/or to the heavy product, and to lead off the remaining quantity in common as both mixture and light fraction.

As stated earlier, the zone of the top vibrating table (region V) for the stream of product adjacent to the product discharge, can be initially layered into a lower (bottom) layer enriched with the heavy product and a layer of lighter product lying thereover, the lower layer enriched with heavy product being drawn off over a region "A" after (downstream of) the initial layering zone, and cast off onto the second vibrating table located thereunder, and actually onto its center region, while the top layer of the lighter product, after the initial layering zone and after drawing off the lower heavy layer of product along the top vibration table into a subsequent second layering zone, region "A" is again layered into a lower layer with an average fraction and into a top layer of quite light fraction, with the bottom layer of the average fraction then being cast off by means of the top vibrating table, downwardly onto an intermediate floor, and fed therefrom to an outlet, while the light fraction remaining on the upper vibrating table is discharged off the end of the upper vibrating table.

Figure 2:
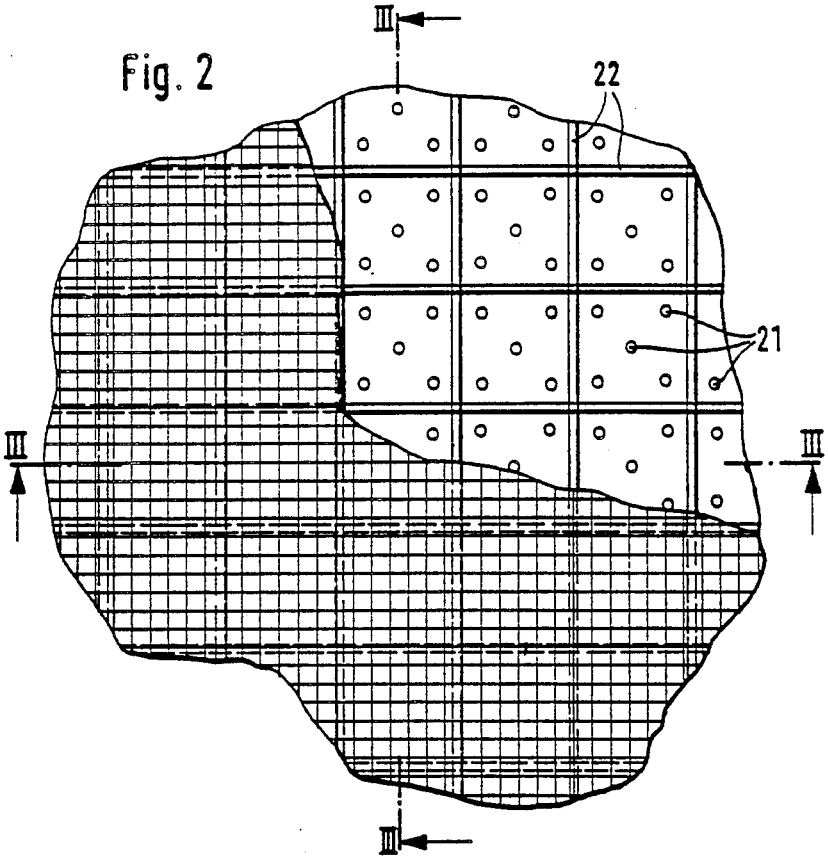
Figure 3:
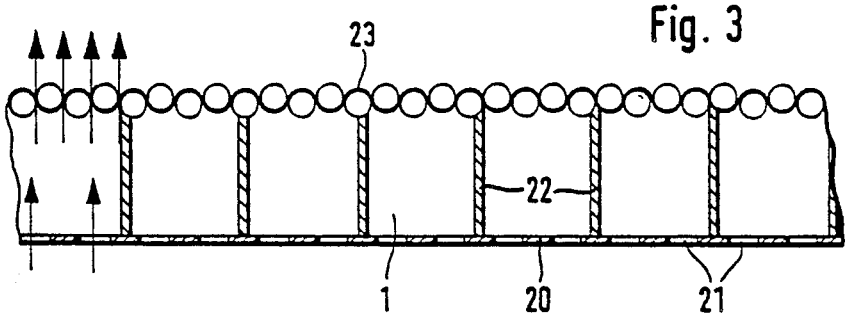
Figure 4:
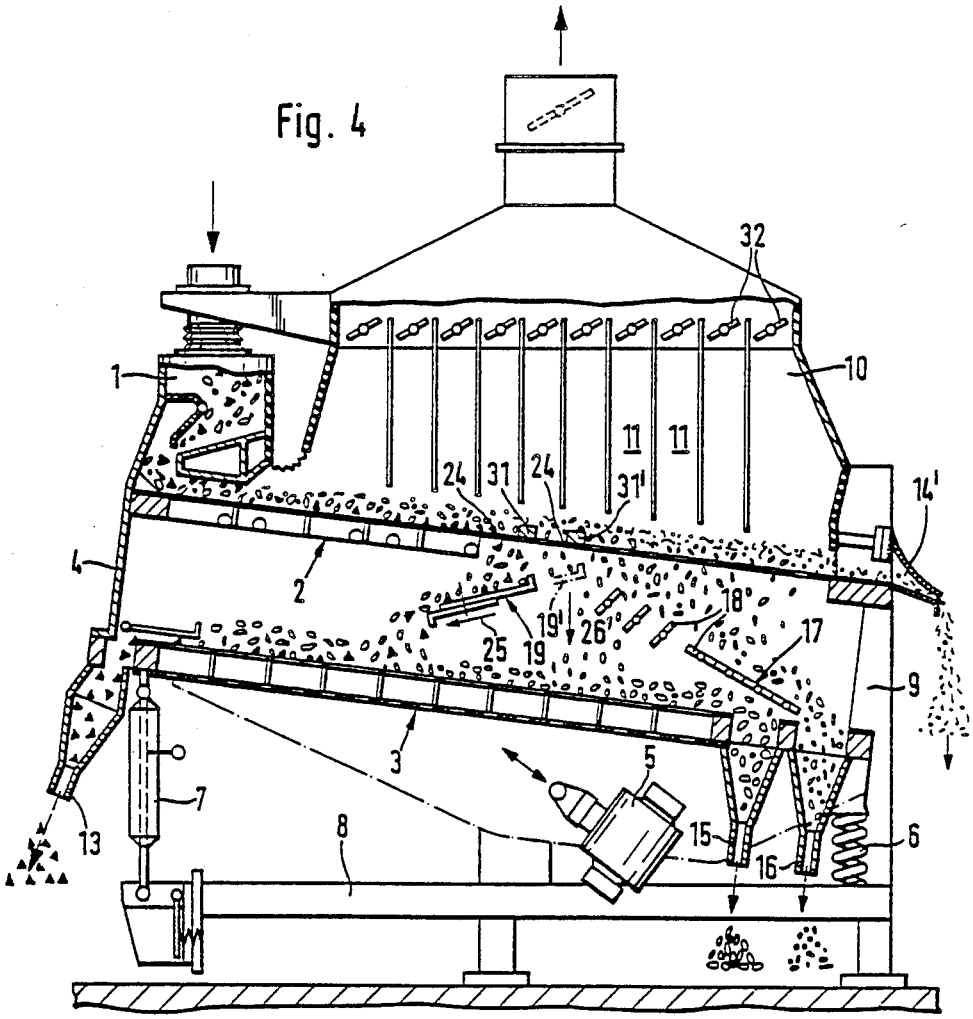

The invention will now be explained in further detail with the aid of some examples of embodiment. Shown are FIG. 1 a vertical cut (in principle) through a contrivance in accordance with the invention, FIG. 2 a partial cutout from a top view onto the lower fluidized bed table, from the contrivance according to FIG. 1, FIG. 3 the cut III—III from FIG. 2, FIG. 4 schematically, the flow of material in the contrivance in accordance with the invention that is based on FIG. 1, FIG. 5 a detail cutout of the contrivance from FIG. 1, FIG. 6 another example of embodiment of a contrivance in accordance with the invention, FIG. 7 a corresponding representation as in FIG. 1 of another example of embodiment of a contrivance in accordance with the invention, FIG. 8*a* an outline of the upper fluidized bed, FIG. 8*b* a dual configuration for large throughput capacities.

The contrivance shown in FIG. 1 displays an inlet 1 for the granular product and/or the raw product that falls directly onto the higher-lying end of a top (upper) fluidized bed table 2. A lower fluidized bed table 3 is built in, at some distance from the top one, in a common frame 4. Both tables are set into oscillation (vibration) along with the frame 4 by means of a vibratory drive 5, for which purpose they are supported on a chassis 8 by means of a spring 6 and a vibration support 7 that is adjustable in height. Additionally attached to the chassis 8 are two lateral wall sections 9, on one of which is installed an exhaust air hood 10 connected to a suction line. This hood is divided by transverse walls into individual zones 11. Each zone 11 displays an air adjustment flapper (damper) 32 so that, in each individual zone, the size of the flow cross-section can be adjusted individually. The upper fluidized bed table 2 displays a light product outlet 14, whereas, associated to the lower fluidized bed table 3 is a stone outlet 13, along with respectively an outlet 15 for the heavy fraction and an outlet 16 for the average mixed fraction.

The upper fluidized bed table 2 further displays, in a region (V), a smooth surface with a large number of fine perforations, region (V) of the upper table surface actually being permeable to air but impermeable for the raw product. Next, located over the entire width of a zone are coarse perforations 24 that can also be replaced by a passthrough slot transversely over the entire width. In a region (A) adjoining the coarse perforations, which extends up to the lite product outlet 14, the table surface like-wise displays coarse, possibly medium-coarse perforations 24' through which the different raw product fractions can fall. Essentially, the fact is here that the upper table has no sifting function since all dropthrough openings are greater than the largest portion of the product stream. Layering is maintained by the stream of air. The entire lower layer falls at the same time through the coarse openings. Here, the openings can, without further ado, come to 20 to 50% of the entire table surface.

The lower fluidized bed table 3 is air-permeable over the entire surface, however, impermeable for the precipitating product. As FIGS. 2 and 3 show, it (the table) displays a hole plate 20 with perforations 21, over which is disposed a parallel mesh screen 23. Provided in the intervening space between the hole plate 20 and the mesh screen 23 are checkered compartment walls 22 that subdivide the flowthrough cross-section for the air into rectangular channels the sum of the cross sections of perforations 21 of plate 20 is less than, or at most, equal to one-tenth part of the total surface of the product deposit surface.

Essential for separating out an average fraction is a floor 17 that permits separating out average weight grants from the product falling through from the upper fluidizing bed table 2. The floor 17 consists of a number of flappers (dampers) 18 that extend from one side wall of the frame 4 to the other and that are pivotably journaled about their longitudinal center in these longitudinal walls. The length of the floor 17 ending at outlet 16, and therewith the quantity measuring portion for the average weight fraction in the product dropping down, is determined by the number of dampers 18 that are rotated coplanar to one another.

Another further essential point lies in the use of a chute 19 that can be adjusted in inclination and length. The chute 19 conveys that portion of product enriched with stones along with the heaviest grains that fall through toward the stone outlet 13, through the upper fluidized bed table 2 adjacent to the first region impermeable to the product.

Once again represented in FIG. 4 is the contrivance relative to its method of functioning, respectiely the flow of material coming out therefrom. The product enters into the contrivance at the inlet 1 and is layered (stratified) in a first region of the top fluidized bed table 2. The stones below, the light bodies (including stalks, seedlings, and the like) above and the remaining grains, spending upon their floating speed, in between. In the example illustrated, approximately in the center region, the lowermost layer is thrown off through the coarse perforations 24 onto the chute 19 and conveyed, in the direction of the arrow 25, toward the stone outlet 13. The stones are carried out at the stone outlet 13. Now, there are still several embodiment ideas contained in FIG. 4.

In each case, it is possible to place onto the stone sorting table, via the chute 19, 20 to 60% of the product. In so doing, the quantity can be adjusted by lengthening the back end of the chute 19'. Advantageously, in so doing, the threshold 31 is adjusted such that it lies directly over the back end of the chute 19'. The threshold 31 simultaneously represents a stop for the heavy layer on the upper table. The precipitate onto the chute 19 is indicated respectively with D and D'. Adjacent to the zone D, respectively D', again formed is a layering between a lower mixed fraction and a quite light fraction. Initially, it is still possible to draw off, directly onto the lower table 3, a selectable portion from the mixed fraction, through the opened damper 18. This portion is fed to the outlet 15 for the heavy grain fraction, via the lower part of the stone sorting table.

Another idea lies in the fact that a proportion of the stream of product is allowed to fall from the top table 2, at the back end of region A, onto the intermediate floor 17 that is formed by closed dampers 18. The lightest fraction can finally be carried out as expellate over the top vibrating table 2.

For very simple needs, it is also possible to produce the chute 19 and the intermediate floor 17 in a single piece, therefore without the possibility of an intermediate fallthrough onto the stone sorting table 3. In this case, the two together form a ceiling inclined to two sides.

Particularly interesting for the overall function of the contrivance is the possibility for dual air control of the suctioning air. On the one hand, achieved with the special method of construction of the lower fluidized bed table 3 is uniform ventilation of the entire table surface, independently of the layer thickness of the granular product. The functioning of the upper fluidized bed table 2 requires, for the regions that follow one another from left to right, i.e. for product layering, for casting off the stones and the heavy grain fraction as well as for separating into medium, heavy and light product, in each case a specifically controlled and adapted quantity of air that is adjustable by means of the adjusting damper 32.

One quite essential point, however, besides supplying air and an appropriate deflection of the product, lies in the possibility of deflecting the product through means of building in the chute 19 and the floor 17. These two add-on structures permit precise guidance and possibly fine-regulation of the streams of product.

Figure 5:
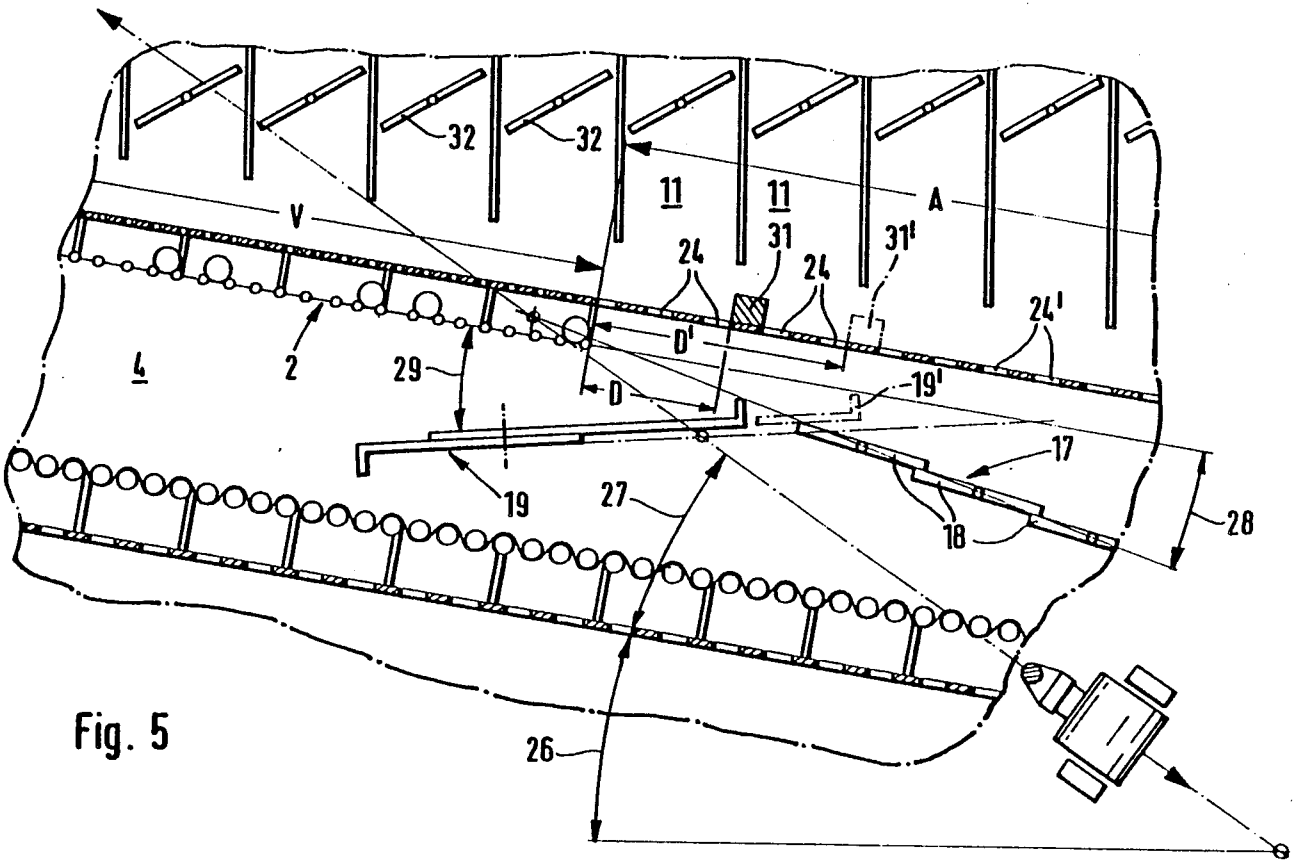

In the case of the cutout from FIG. 1 shown in FIG. 5, the floor 17 and the chute 19 are represented in a larger scale. The two fluidized bed tables 2 and 3 are preferentially parallel to each other and are adjustable between 5° and 10° with reference to a horizontal plane (angle 26) by means of the vibration support 7.

The direction of oscillation of the vibratory drive 5 cuts (intersects) the fluidized bed tables 2 and 3 at an angle of 25° to 45° (angle 27), where, on the other hand, the plane of the floor 17 and/or the plane of the chute 19 with those of the fluidized bed tables 2 and 3, each include an angle from 5° to 40° (angle 28) and/or each an angle from 0° to 65° (angle 29). When operating the contrivance, the inclination of the lower fluidized bed table 3 is set such that it is most favorable for separating out the stones through outlet 13. However, as a rule, the inclination of the upper (top) fluidized bed table 2 may be not quite so optimal for separating the remaining fractions (since the two tables are firmly joined together through the frame 4). With the capability of longitudinal adjustment of the floor 17, particularly in the case of strong differences in throughput, the amount of the mixed fraction to be brought out through outlet 16 can be increased or decreased at the expense of the heavy grain fraction to be brought out through outlet 15. Because of the inclination of the floor 17, the product falling thereupon, in spite of the oppositely acting direction of vibration of the vibratory drive 5, can flow off without delay in the outlet 16.

Figure 6:
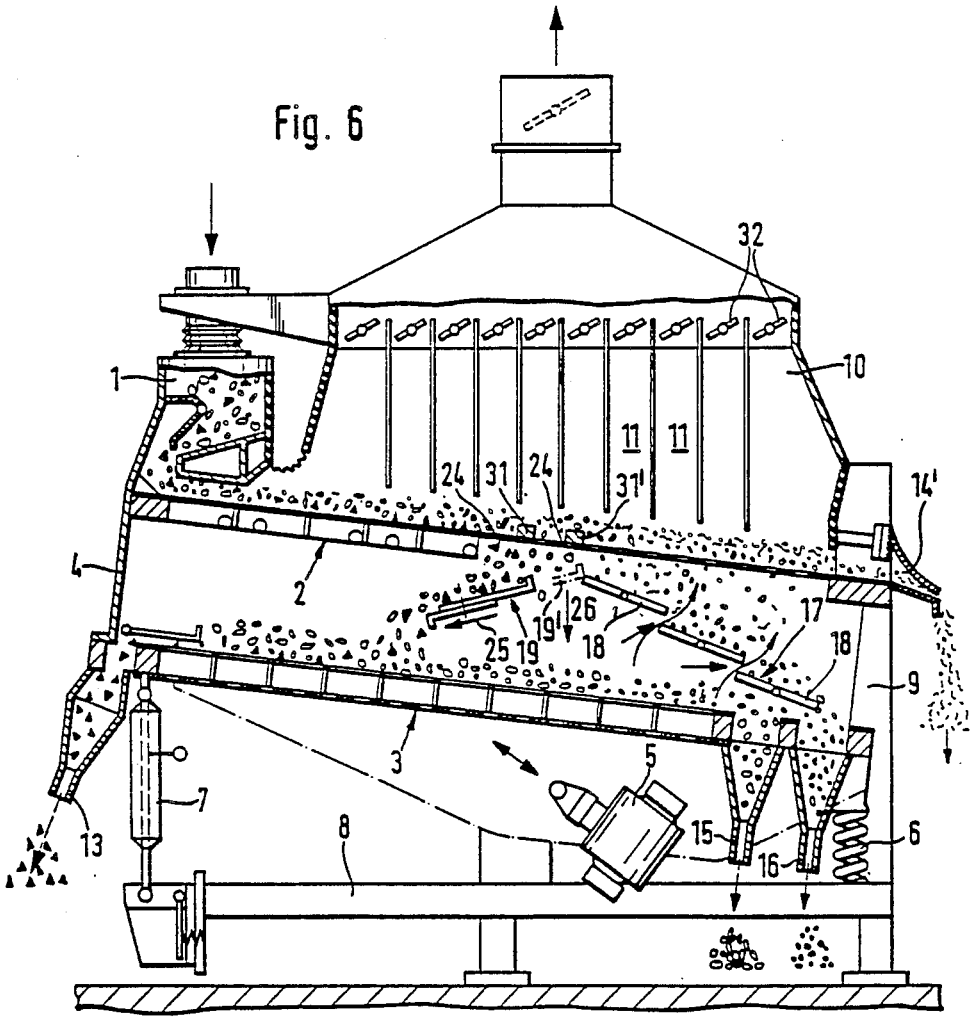

As FIG. 6 shows, the floor 17 can also be embodied in steps, whereby in the region of the steps, suction air can flow from the lower fluidized bed table 3 to the upper one, rendering easier a uniform flowthrough of air through this latter; the lightest fraction (husks, stalks, etc.) is carried out through an outlet 14' as expellate of the upper layer table 2.

The chute 19 lies with its top end under the region (D) immediately joining the initial loading region of the upper fluidized bed table 2, through which practically all stones fall in order to guide (feed) these inasmuch as possible into the center region of the lower table 3. Preferentially, the chute 19 is journaled in the frame 4 in longitudinally displaceable fashion, so that its upper end can be brought closer to or further away from the end of the initial loading region of the upper fluidized bed table 2. In this manner, it becomes possible to pick off practically all of the stones with the chute 19 and transfer them over to the lower fluidized bed table 3 for final separation.

Figure 7:
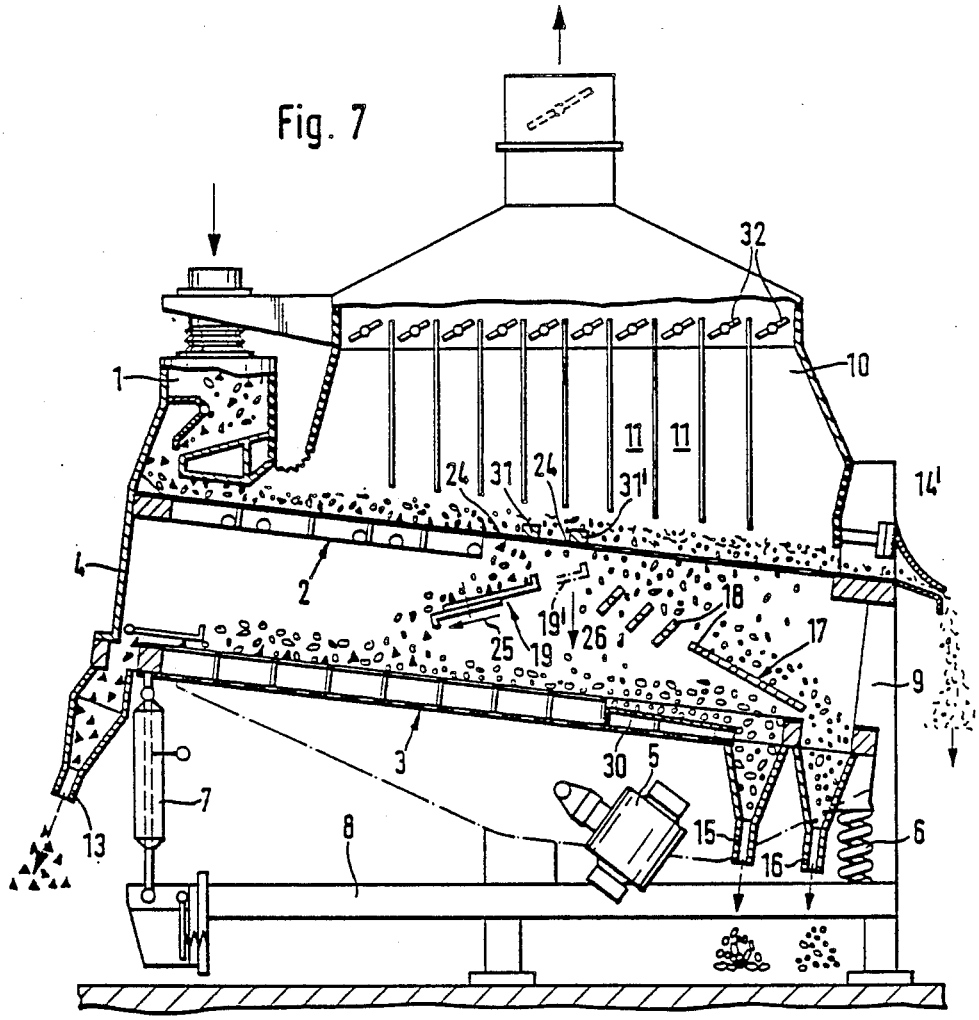

In the case of the example of embodiment according to FIG. 7, the same reference numbers designate the same or equivalent parts as for the example based on FIG. 1, hence, a repetition of their description will be eliminated. In this example of embodiment, disposed over the top fluidized bed table 2, in the zone of coarse perforations 24, is a transversely oriented threshold 31. Depending upon the product throughput and arrangement of the top pick-off end 19' of the chute 19, the threshold 31 can also be disposed in adjustable fashion. In this example of embodiment, zone "V" for initial layering (loading) of the product is approximately as long as zone "A" for separating the light fractions and/or a mixed fraction.

The lower fluidized bed table 3 further displays a non-aerated piece of floor 30. The piece of floor 30 has several functions. The proportion of heavy fraction cast off from zone "A", after the chute 19, directly onto the lower fluidized bed table 3 no longer interferes with the layering process on the lower fluidized bed table 3, since, at this point, no piling up can occur.

A second function lies in the fact that the entire quantity of air enters through that part of the lower fluidized bed table 3 in which the air is also actually used. The air enters only there and respectively through the contrivance where it must accomplish work.

Figure 8A:
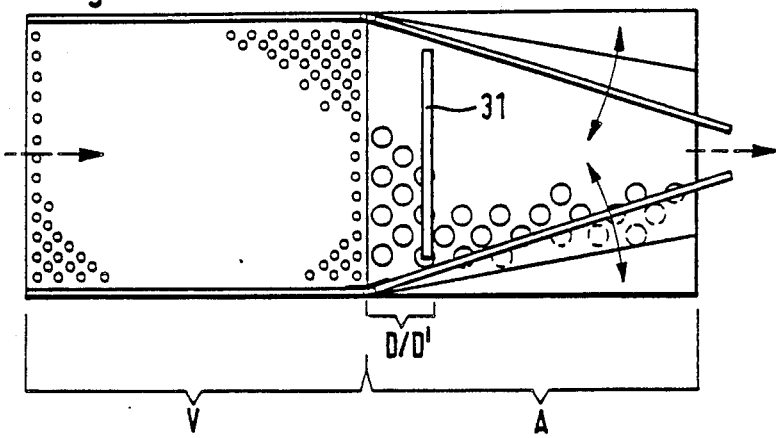

FIG. 8*a* is a top view onto the upper vibrating table. The table displays, in a first region "V", a rectangular form. The adjacent zone "A" becomes narrower toward the outlet in order to maintain layering correct up to the end, with progressive fallthrough of the product through the region "A".

Figure 8B:
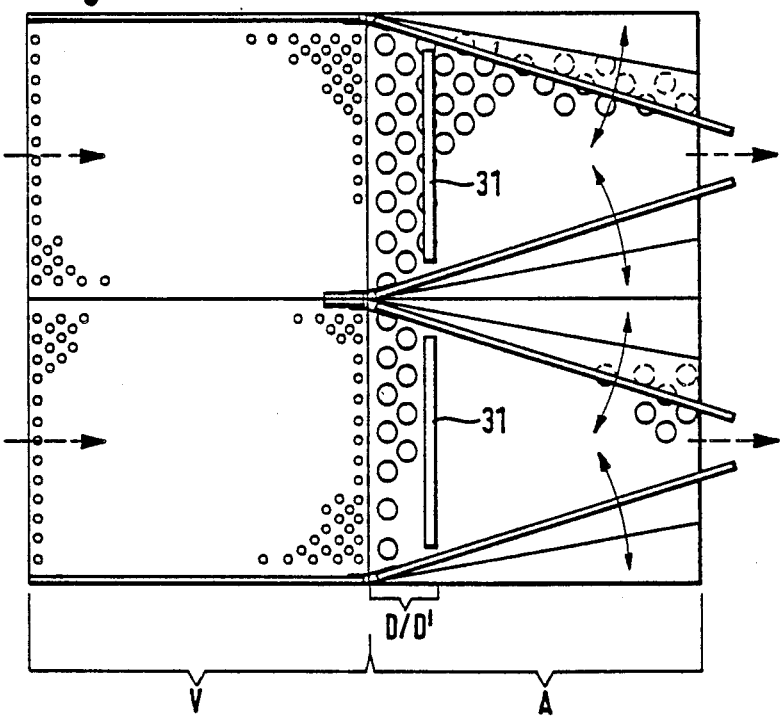

FIG. 8*b* shows merely a doubling of FIG. 8*a*. The contrivance described is in particular fashion suited for separating out heavy parts such as glass splinters, fine metal parts, stones and the like, heavy grains, cracked, blighted and light grains, seeds, husks, dirt and the like from cereals. It has also been shown that a practically identical statement of the task exists in the case of composted earth, namely removal of heavy parts and light material from the comminuted, in particular ripe, dried, humus compost, provided the material can be fluidized. In the foreground are three fractions, the heavy parts (stones, glass splinters, fine metal parts), the light parts (small pieces of synthetic materials), as well as the main mass of good composted earth.

I claim:

1. In a device for separating granular product into several fractions, with upper and lower fluidized bed tables journaled in vibratory fashion and adjustable in their inclination and capable of being permeated by a common stream of air, there being disposed above a higher end of the upper fluidized bed table an inlet for the granular product, opposite to which at a lower end is an outlet for the lightest grain fraction, and there further being present at a higher end of the lower fluidized bed table a stone outlet and, at a lower end, an outlet for the heavy granular fraction, and with an intermediate floor of lesser length disposed between the fluidized bed tables for leading off a mixed fraction, which extends from the lower ends of the fluidized bed tables in the direction toward the higher ends, the improvement comprising:

the fluidized bed tables being disposed in a stiff frame and journaled in vibratory fashion, to which is associated a common vibratory drive whose casting, vibratory movement is directed toward the stone outlet, with said intermediate floor being inclined toward said lower end of said lower fluidized table, with said upper fluidized table having a smooth but finely perforated surface, and with said lower fluidized table having a coarse surface.

2. A device according to claim 1, wherein the upper fluidized bed table includes a zone of coarse perforations extending toward the lower end, transversely over said upper fluidized bed table, adjacent to a first region of product-unpermeable, fine perforations at the higher end thereof.

3. A device according to claim 2, wherein adjacent to a lower end of the zone of coarse perforations there is provided, transversely over said upper fluidized bed table, a threshold having a height at least once to twice the average grain dimension.

4. A device according to 2, wherein there are provided in a region of the upper fluidized bed table at the lower end thereof, opposing adjustable side walls for working surfaces of said upper fluidized bed table, that are capable of being pivoted opposite to one another with their ends facing toward the outlet for the lightest grain fraction, for the purpose of tapering, wedge-fashion, the active surfaces of the upper fluidized bed table toward the outlet for the lightest grain fraction.

5. A device according to claim 2, wherein there is provided under a center region of the upper fluidized table a chute leading toward the outlet for the stones dropping down, and passing under the zone of coarse perforations in said upper table.

6. A device according to claim 5, wherein the chute is adjustable in its length and/or inclination between the first region and the adjacent zone of coarse perforations.

7. A device according to claim 6, wherein the chute, approximately at the center of its height, ends between the upper and lower fluidized bed tables, and over the length of the lower fluidized bed table in approximately its central one-third.

8. A device according to claim 1, wherein the intermediate floor is adjustable in length in the direction from the lower end of the fluidized bed tables toward the higher end.

9. A device according to claim 1, wherein the intermediate floor cuts the fluidized bed tables at an angle from 25° to 40° and wherein the inclination of the fluidized bed tables, relative to the horizontal, amounts to 5° to 10°.

10. A device according to claim 1, wherein the intermediate floor is formed by a plurality of flat profiles that are rotatably journaled, about their longitudinal center axis, in the frame.

11. A device according to claim 10, wherein the flat profiles contact each other mutually in coplanar alignment.

12. A device according to claim 11, wherein the flat profiles are stepped and, with the steps, form an air throughpass opening.

13. A device according to claim 1, wherein an outlet for a mixed fraction adjoins in coplanar fashion, in the plane of the lower fluidized bed table, the outlet for the heavy grain fraction.

14. A device according to claim 1, wherein the lower fluidized bed table displays an air permeable product deposit surface, there being disposed under the product deposit surface, in parallel and at some distance away, a finely perforated plate, that commonly yield an approximately constant air resistance over the entire lower product deposit surface, independently of the product layer thickness on the lower table.

15. A device according to claim 14, wherein the sum of the hole cross-sections of the finely-perforated plate is less than, or at most, equal to one-tenth part of the total surface of the product deposit surface.

16. A device according to claim 1, wherein the upper fluidized bed table, in the direction from the inlet toward the outlet for the lightest grain fraction, is divided into first and second sequential regions having a different-sized perforations, such that the granular fractions mentioned can only fall through the upper fluidized bed table in the lower second region following the upper first region.

17. A device according to claim 16, wherein the first region is approximately the same length as the second region.

18. A device according to claim 1, wherein an open discharge air cross-section is divided, at some distance over the upper fluidized bed table into zones that are adjustable in cross-section by compartment walls, with each zone including an adjustment damper for setting the quantity of airflow therethrough.

19. A device according to claim 1, wherein the upper and lower fluidized bed tables form a vibratory unit with a discharge air hood disposed thereover which is firmly joined via supports with a fixed chassis.

20. In a device for separating granular product into several fractions, with upper and lower fluidized bed tables journaled in vibratory fashion and adjustable in their inclination and capable of being permeated by a common stream of air, there being disposed above a higher end of the upper fluidized bed table an inlet for the granular product, opposite to which at a lower end is an outlet for the lightest grain fraction, and there further being present at a higher end of the lower fluidized bed table a stone outlet and, at a lower end, an outlet for the heavy granular fraction, and with an intermediate floor of lesser length disposed between the fluidized bed tables for leading off a mixed fraction, which extends from the lower ends of the fluidized bed tables in the direction toward the higher ends, the improvement comprising:

the fluidized bed tables being disposed in a stiff frame and journaled in vibratory fashion, to which is associated a common vibratory drive whose casting, vibratory movement is directed toward the stone outlet;

said intermediate floor being inclined toward said lower end of said lower fluidized table; and the lower fluidized bed table being constructed, beneath the intermediate floor, as a gutter-like depression having an air-impermeable floor, with the depression guiding the heavy granular fraction into the associated outlet.

* * * * *

UNITED STATES PATENT AND TRADEMARK OFFICE

CERTIFICATE OF CORRECTION

PATENT NO. : 4,913,804

DATED : April 3, 1990

INVENTOR(S) : Muller

It is certified that error appears in the above-identified patent and that said Letters Patent is hereby corrected as shown below:

Column 3, line 31, "divied" should read --divided--.

Column 6, line 15, "theproduct" should read -- the product--.

Column 6, line 62, insert -- - -- after the word "veil".

Column 9, line 13, "respectiely" should read --respectively--.

Column 9, line 19, "spending" should read --depending--.

Signed and Sealed this

Fifteenth Day of December, 1992

*Attest:*

DOUGLAS B. COMER

*Attesting Officer*

*Acting Commissioner of Patents and Trademarks*